US008434795B2

(12) United States Patent
Antonetti

(10) Patent No.: US 8,434,795 B2
(45) Date of Patent: May 7, 2013

(54) DUAL DOOR RELEASE HANDLE

(75) Inventor: Thomas Antonetti, Fresno, CA (US)

(73) Assignee: Saf-T-Cab, Inc., Fresno, CA (US)

( * ) Notice: Subject to any disclaimer, the term of this patent is extended or adjusted under 35 U.S.C. 154(b) by 1293 days.

(21) Appl. No.: 12/179,500

(22) Filed: Jul. 24, 2008

(65) Prior Publication Data

US 2009/0033105 A1 Feb. 5, 2009

Related U.S. Application Data

(60) Provisional application No. 60/963,254, filed on Aug. 2, 2007.

(51) Int. Cl.
*E05C 1/02* (2006.01)

(52) U.S. Cl.
USPC ..... 292/137; 292/DIG. 17; 292/DIG. 15

(58) Field of Classification Search ..... 292/137, 292/192, DIG. 15, DIG. 19, DIG. 17 X
See application file for complete search history.

(56) References Cited

U.S. PATENT DOCUMENTS

| | | | | |
|---|---|---|---|---|
| 109,962 | A * | 12/1870 | Stafford | 16/71 |
| 1,639,009 | A * | 8/1927 | Singley | 403/95 |
| D157,942 | S | 4/1950 | Collin | |
| D176,624 | S | 1/1956 | McIntosh | |
| 3,182,605 | A | 5/1965 | Brasher | |
| 3,595,409 | A | 7/1971 | Nowman-Shaw | |
| 3,841,429 | A | 10/1974 | Falcone et al. | |
| D237,996 | S | 12/1975 | Pierre | |
| 4,049,305 | A | 9/1977 | Zetterelund et al. | |
| D259,045 | S | 4/1981 | Mende | |
| 4,421,188 | A | 12/1983 | Fredriksen | |

(Continued)

FOREIGN PATENT DOCUMENTS

JP 63013867 A 1/1988

OTHER PUBLICATIONS

Caterpillar, Products,Machines,Wheel Loaders [online][retrieved Nov. 12, 2003]fromCaterpiller Website; <URLhttp://www.cat.com; 3 pages.

(Continued)

*Primary Examiner* — Carlos Lugo
*Assistant Examiner* — Mark Williams
(74) *Attorney, Agent, or Firm* — Mark D. Miller

(57) ABSTRACT

The present invention is a dual door release handle and related mechanisms for use with cabs of industrial vehicles that an operator may reach from outside of such a cab in order to fully release a door that has been propped open in order to close it. The dual door release handle of the present invention includes a latching mechanism having a handle mounted on the inside of the cab that extends into the doorway such that it may be reached through the open door of the cab by an operator who is located outside and/or below the cab. A linkage is provided between this handle and an operable device associated with the release mechanism inside the cab. The linkage is operatively attached to the handle and to the release mechanism such that turning the handle causes the linkage to move the release mechanism. Movement of the handle pulls the linkage and releases the holdback holding the open door against the side of the cab. Thus, an operator may reach up into the cab from the outside and pull down on the interior handle in order to release the door from its holdback position against the side of the cab allowing the door to swing freely so that it may be closed.

23 Claims, 22 Drawing Sheets

U.S. PATENT DOCUMENTS

| | | | | |
|---|---|---|---|---|
| 4,451,079 | A | 5/1984 | Takahashi | |
| D323,659 | S | 2/1992 | Jacabsson | |
| 5,096,253 | A | 3/1992 | Jo et al. | |
| 5,199,193 | A | 4/1993 | Akiba et al. | |
| 5,236,294 | A | 8/1993 | Willis | |
| 5,253,906 | A | 10/1993 | Rogers, Jr. et al. | |
| 5,273,340 | A | 12/1993 | Nelson et al. | |
| 5,286,073 | A * | 2/1994 | Ui | 292/216 |
| 5,504,974 | A | 4/1996 | Graber | |
| D376,604 | S | 12/1996 | Johnson | |
| 5,618,146 | A | 4/1997 | Cooper | |
| D381,178 | S | 7/1997 | Feider et al. | |
| 5,655,798 | A | 8/1997 | Kaveney et al. | |
| D389,984 | S | 1/1998 | Johansson | |
| D391,273 | S | 2/1998 | Linder | |
| D394,069 | S | 5/1998 | Muranen | |
| 5,749,611 | A | 5/1998 | Watson et al. | |
| D398,616 | S | 9/1998 | Kwak et al. | |
| D410,472 | S | 6/1999 | Hinsperger | |
| D415,772 | S | 10/1999 | Hinspeger | |
| D427,612 | S | 7/2000 | Shim | |
| 6,085,463 | A | 7/2000 | Yoshikawa | |
| D445,233 | S | 7/2001 | Deroure | |
| D450,905 | S | 11/2001 | Deroure | |
| 6,408,971 | B1 | 6/2002 | Grant | |
| D463,461 | S | 9/2002 | Yanagida et al. | |
| D463,462 | S | 9/2002 | Yanagida et al. | |
| D463,807 | S | 10/2002 | Tamaru et al. | |
| D471,213 | S | 3/2003 | Kwak et al. | |
| 6,550,845 | B1 | 4/2003 | Pietryga | |
| 6,568,746 | B2 | 5/2003 | Sakyo et al. | |
| D479,536 | S | 9/2003 | Dahl et al. | |
| D481,044 | S | 10/2003 | Tokach et al. | |
| D494,986 | S | 8/2004 | Tokach et al. | |
| D497,920 | S | 11/2004 | Antonetti | |
| 6,848,737 | B2 | 2/2005 | Mikolai et al. | |
| D505,432 | S | 5/2005 | Antonetti | |
| 6,964,440 | B2 | 11/2005 | Lebsack et al. | |
| 7,004,275 | B1 | 2/2006 | Junga et al. | |
| 7,096,538 | B2 | 8/2006 | Liang et al. | |
| 7,988,210 | B2 * | 8/2011 | Shibata et al. | 292/340 |
| 2002/0040820 | A1 | 4/2002 | Takano et al. | |
| 2002/0153748 | A1 | 10/2002 | Sakyo et al. | |
| 2003/0217984 | A1 | 11/2003 | Lissandre | |
| 2004/0104060 | A1 | 6/2004 | Mori et al. | |
| 2004/0217628 | A1 | 11/2004 | Neunteufel et al. | |

OTHER PUBLICATIONS

Caterpillar,Products,Machines,Compactors[online][retrieved Nov. 12, 2003]from Caterpillar Website;<URL http://www.cat.com>; 2 pages.

Hamm Compactors,Asphalt[online][retrieved Nov. 12, 2003]from Hamm Compactors Website; <URLhttp://www.hammcompactors.com>; 2 pages.

Hamm Compactors,Soil[online][retrieved Nov. 12, 2003]from Hamm Compactors website;<URL http://www.hammcompactors.com>; 1 page.

Construction Machiner Industrial,Products,Wheel Loaders[online][retrieved Nov. 12, 2003]from Volvo Sebsite;<URL http://www.volvo.com>; 2 pages.

Manitou,United Kingdom[online]retrieved Nov. 12, 2003]from Maitou Website;<URL http://ww.manitou.com>; 2 pages.

John Deer Brochure re New Telehandlers 300 Series; 2005;16 pages.

JLG Industries (Europe) Brochure re JLG 3500 & 4000 Series Telescopie Handlers; 2005; 6 pages.

Caterpillar,Mini Hydraulic Excavators, web page, 2005, 3 pages availiable at http://www.cat.com/cda/layout?m=50146&x=7.

Manitowoc Crane Group,Grove RT530E product guide, 2004,12 pages, available at http://www.worldwide.com/na/eng/crane/rt/rt530e/RT530E%20PG.pdf.

Ingersoll-Rand, Alexander DD 95, web page, 2005 2 pages available at http://www.ir-abg.com/eng/1187.html.

* cited by examiner

SECTION B-B

| ITEM NO. | DESCRIPTION | | | QTY |
|---|---|---|---|---|
| 26 | SEE DETAIL | - | XX | 1 |
| 25 | SEE DETAIL | - | XX | 1 |
| 24 | P190715 | - | DETENT STOP | 1 |
| 23 | P190XXX | - | SPRING | 1 |
| 22 | SEE DETAIL | - | XX | 1 |
| 21 | SEE DETAIL | - | HEX NUT - M4 X 0.7 PITCH PLATED | 1 |
| 20 | | | | |
| 19 | SEE DETAIL | - | WASHER - M4 NARROW PLATED | 1 |
| 18 | SEE DETAIL | - | WASHER - M6 NARROW PLATED | 1 |
| 17 | | | | |
| 16 | SEE DETAIL | - | BOLT - M4 X 0.7 PITCH X 16MM LG SOCKET BUTTON HEAD | 2 |
| 15 | SEE DETAIL | - | BOLT - M6 X 1.0 PITCH X 20MM LG SOCKET BUTTON HEAD | 1 |
| 14 | SEE DETAIL | - | BOLT - M6 X 1.0 PITCH X 12MM LG HEX HEAD | 2 |
| 13 | P190119 | - | HARD PLASTIC WASHER | 1 |
| 12 | P190227 | - | SCREW HEAD COVER | 1 |
| 11 | P190655 | - | RUBBER GRAB HANDLE | 1 |
| | 195068 | | | |
| 10 | P190719 | - | SLEEVE | 1 |
| 9 | P190718 | - | BUSHING | 1 |
| 8 | SEE DETAIL | - | SUBASSEMBLY | 1 |
| 7 | SEE DETAIL | - | SUBASSEMBLY | 1 |
| 6 | SEE DETAIL | - | BAR - ROUND 1 3/4 OD | 1 |
| 5 | SEE DETAIL | - | BAR - ROUND 1 3/4 OD | 1 |
| 4 | SEE DETAIL | - | PLATE - 12 GA | 1 |
| 3 | SEE DETAIL | - | PLATE - 3/16 | 1 |
| 2 | SEE DETAIL | - | PLATE - 1/4 | 1 |
| 1 | SEE DETAIL | - | PLATE - 1/4 | 1 |

TOTAL WT.: XXX LBS. LIST OF MATERIALS

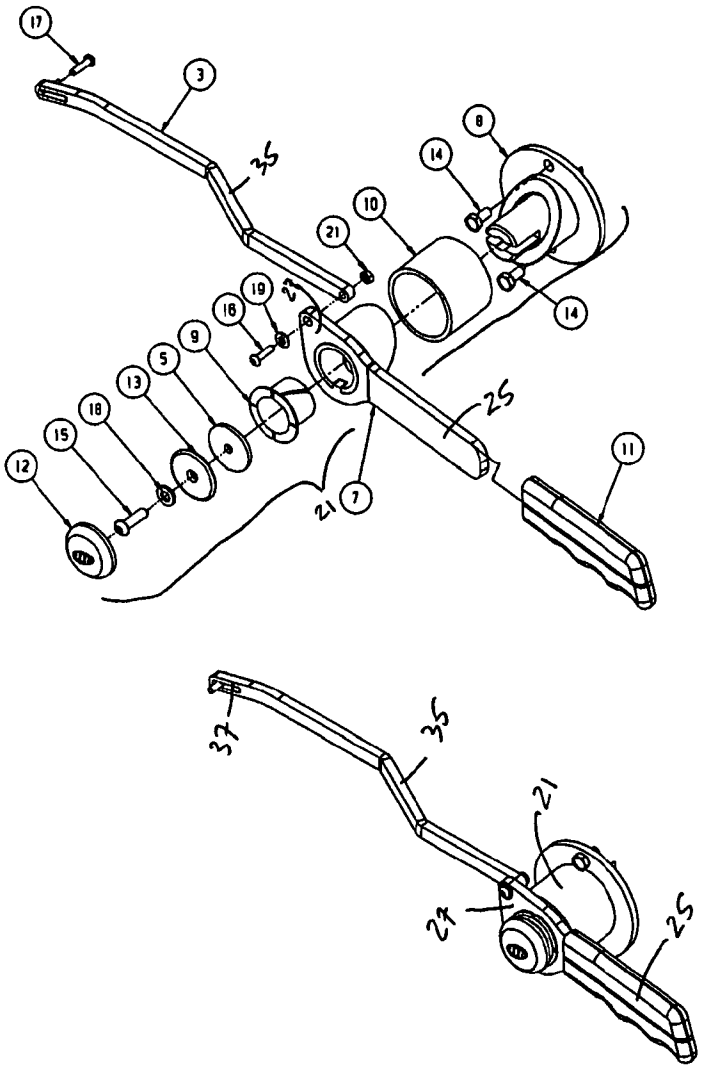

Fig. 16 A

DUAL DOOR RELEASE HANDLE

This application claims the benefit of U.S. Provisional Application Ser. No. 60/963,254 filed on Aug. 2, 2007 which is incorporated herein by this reference.

BACKGROUND OF THE INVENTION

1. Field of the Invention

The present invention relates to doors for operator compartments of industrial vehicles, and more specifically to a new and improved dual action door handle and release mechanism that can be used for one or both of (a) allowing a door of a cab of an industrial vehicle to be released from an intermediary position so that it may be swung wide open, and/or (b) releasing such a door that has been propped wide open so that it may be easily closed, both operations being possible from inside or outside of the cab.

2. Description of the Prior Art

Vehicles, particularly industrial vehicles, ordinarily include an operator compartment or cab which contains a seat for the operator, and controls for operating the vehicle. Cabs are often enclosed for safety reasons, noise reduction, protection from adverse weather conditions and the like. Such cabs are typically positioned above the main chassis of the vehicle such that the operator must step or climb up in order to enter the cab. Hand rails and/or steps may be provided on the outside of the cab to assist the operator in climbing into the cab. Typically, one or more hingedly mounted doors are provided on a side of the cab through which the operator may gain entry. An exterior latching handle on such a door is used to open it.

For many cab doors, once the door has been opened, it is free to swing on its hinges through an arc that is sufficiently wide to allow an operator to enter the cab through the open door. In many cabs, it is generally unnecessary for the door to swing open beyond an arc of about 90 degrees, since this is usually sufficient for the operator to gain access. As a result, door latches have been developed that prevent the door from opening beyond about 90 degrees without further operator intervention. In many cases a release latch must be operated if the door is to be opened beyond 90 degrees.

During use of the industrial vehicle, it may be desirable for the door to be propped open for cooling, ventilation, loading, repair or the like. In these situations, the operator must operate a first latch release, unlatching the door and allowing it to open as wide as 180 degrees, bringing the door against the side of the cab. An intermediate stop may be provided at around 90 degrees, so that the door does not swing completely open, allowing an operator to easily close the door after entering the cab. A coupling is typically provided on the door which engages a mating surface on the side of the cab to hold the door wide open, if desired, against the side of the cab (door holdback) until the coupling is released. A typical coupling release mechanism is provided in the form of a button or lever located on the inside of the cab in the vicinity of the mating surface. This allows an operator inside the cab to push the button/lever in order to release the coupling and allow the door to swing freely so that it may be closed. As such a door is closed, an intermediate latch may engage the door when it has closed to within about 90 degrees, as disclosed in U.S. Pat. No. 7,096,538, requiring the operator to operate another release in order to fully close the door. As a result, simply closing the door may require the operator to operate two release mechanisms.

In many cases, the vehicle operator will exit and descend from the cab while the door is propped open and coupled to the side of the cab. Then, in order to release the door to close it, the operator must climb back up into the cab and then reach into the back of the cab in order to push the button (or move the lever) to release the door from the coupling. Moreover, the operator may then also be required to release the interior latch to allow the door to fully close. It is time consuming and inconvenient for the operator to have to climb back up into the cab, and to operate two separate mechanisms just to close the door.

One patent which addresses this situation is U.S. Pat. No. 5,655,798 which discloses a ground level extension from a cab level door latch that may be used to release a first latch to open the door, or release a second latch to close it. However, the extension cannot easily be reached when the door is latched in the open position since at such times the extension is sandwiched between the door and the side of the cab. An operator must reach outside of the cab in order to unlatch the latched-opened door in order to close it. In addition, nothing in this patent provides an intermediate stopping position, or otherwise prevents a partially opened (unlatched) door from swinging completely open and latching in a full open position against the side of the cab.

It is therefore desirable to provide a single release mechanism for the door of a cab of an industrial vehicle that allows a door that has been propped open to be easily closed from inside the cab, or from outside of the cab without having to climb back into the cab.

SUMMARY OF THE INVENTION

The present invention provides a dual door release handle and related mechanisms for use with cabs of industrial vehicles that an operator may reach from outside of such a cab in order to fully release a door that has been propped open in order to close it. The dual door release handle of the present invention includes a latching mechanism having a handle mounted on the inside of the cab that extends into the doorway such that it may be reached through the open door of the cab by an operator who is located outside and below the cab. The handle is primarily used to open the cab door from the inside. However, a linkage is provided between this handle and a lever or other operable device associated with a door holdback release mechanism inside the cab. The linkage is operatively attached to the handle and to the release mechanism such that turning the handle causes the linkage to move the release mechanism. Downward movement on the handle pulls the linkage and releases the door holdback that is holding the open door against the side of the cab. An operator inside the cab may operate the handle or the holdback release mechanism to release the door for closing. In addition, the present invention allows an operator outside of the cab to reach up into the cab from the outside and pull down on the interior handle in order to release the door from the holdback against the side of the cab allowing the door to swing freely so that it may be closed.

The latching mechanisms of the present invention also include a latch bolt assembly that is attached to the cab that stops progress of the door at a given position while it is being opened, but does not stop the door while it is being closed. These assemblies are operatively connected to the interior handle and to a latch bolt that protrudes to the exterior of the cab. A spring or other biasing means in the assembly causes the latch bolt to extend out when at rest. These assemblies are designed such that moving the interior handle a very short distance is sufficient to fully retract the latch bolt, which extends back out when the handle is released. The latch bolts of the present invention works in conjunction with corresponding cams with stops that are mounted on the cab door to stop the outward (opening) swinging motion of the door at a particular point, but do not stop the door while it is being closed. The stopping point may be any suitable location that allows the door to be sufficiently opened so that an operator may enter, and is determined by the position of the stop on the cam.

When the cab door is opened, it is capable of swinging on its mounting binges for up to about 90 degrees before its motion is stopped by the interaction of a cam stop and a latch bolt of the present invention. The exact position where the door is stopped by the cam and latch bolt may be anywhere along the arc through which the door swings, but is typically between about 30 degrees and 60 degrees from the closed position. Then, in order to open the door (wider) beyond this stop, it is necessary to operate the interior handle (turning it up or down) in order to retract the latch bolt and allow the door to move beyond the cam stop. Once this is done, the door is free to swing all the way open, and may be moved up against the side of the cab and coupled against the side of the cab (hold-back) to hold it in place.

In order to close a cab door that has been propped fully open as above, the holdback coupling must first be released. This may be accomplished by pulling down on the interior handle which the operator may reach from outside the cab. Since the stop is only on one side of the cam, it only operates to arrest motion of the door while it is opening, not while it is closing. Thus, when the door is released from the holdback coupling in order to be closed, it is not stopped again as it is being closed. This allows the door to be released and then fully closed following a single pull on the interior handle.

BRIEF DESCRIPTION OF THE DRAWINGS

FIG. 16A is an exploded view of an embodiment of the present invention.

DETAILED DESCRIPTION

Figure 1:
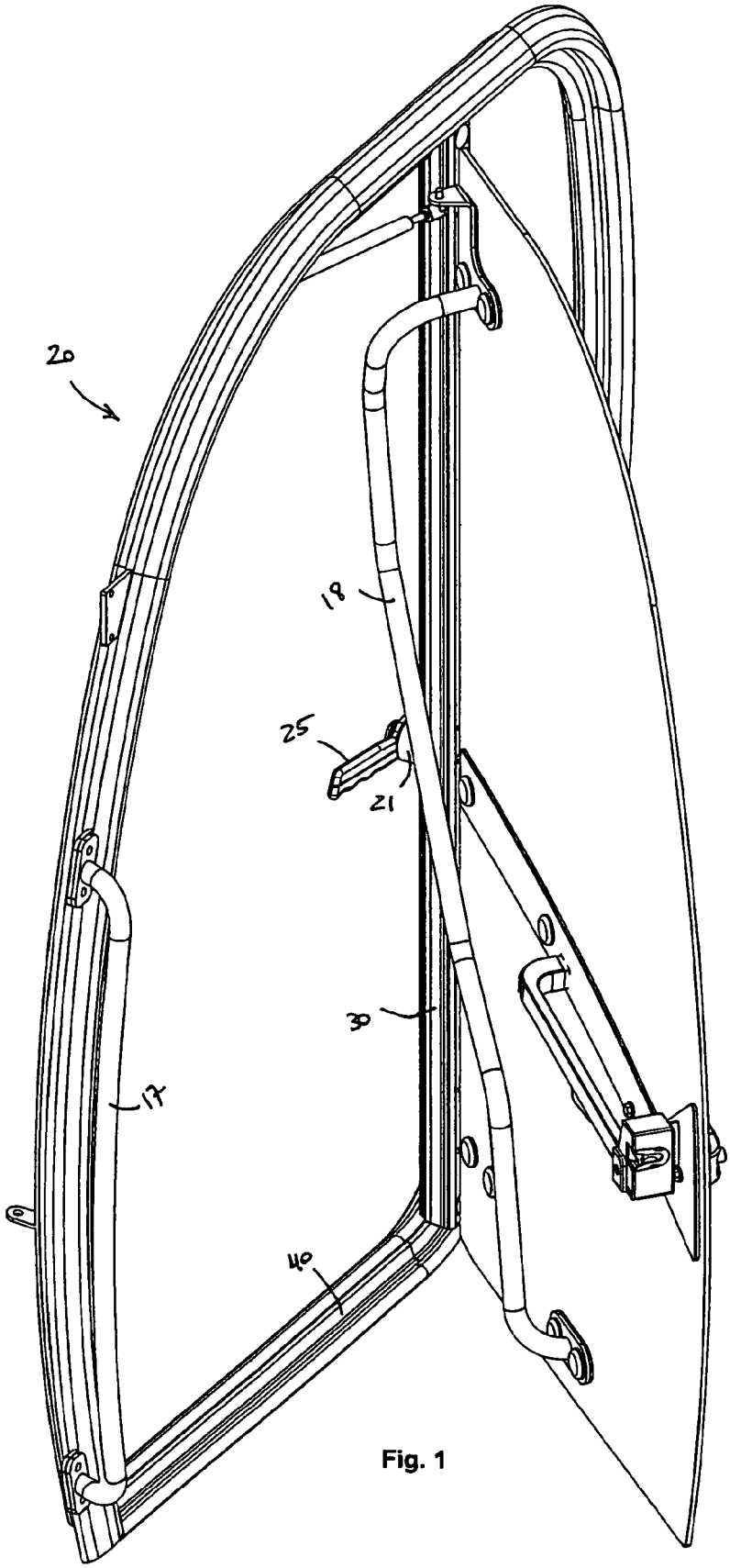
FIG. 1 is an exterior perspective view of an embodiment of the present invention illustrating a cab door in a partially opened position that has been stopped from opening further.
Figure 2:
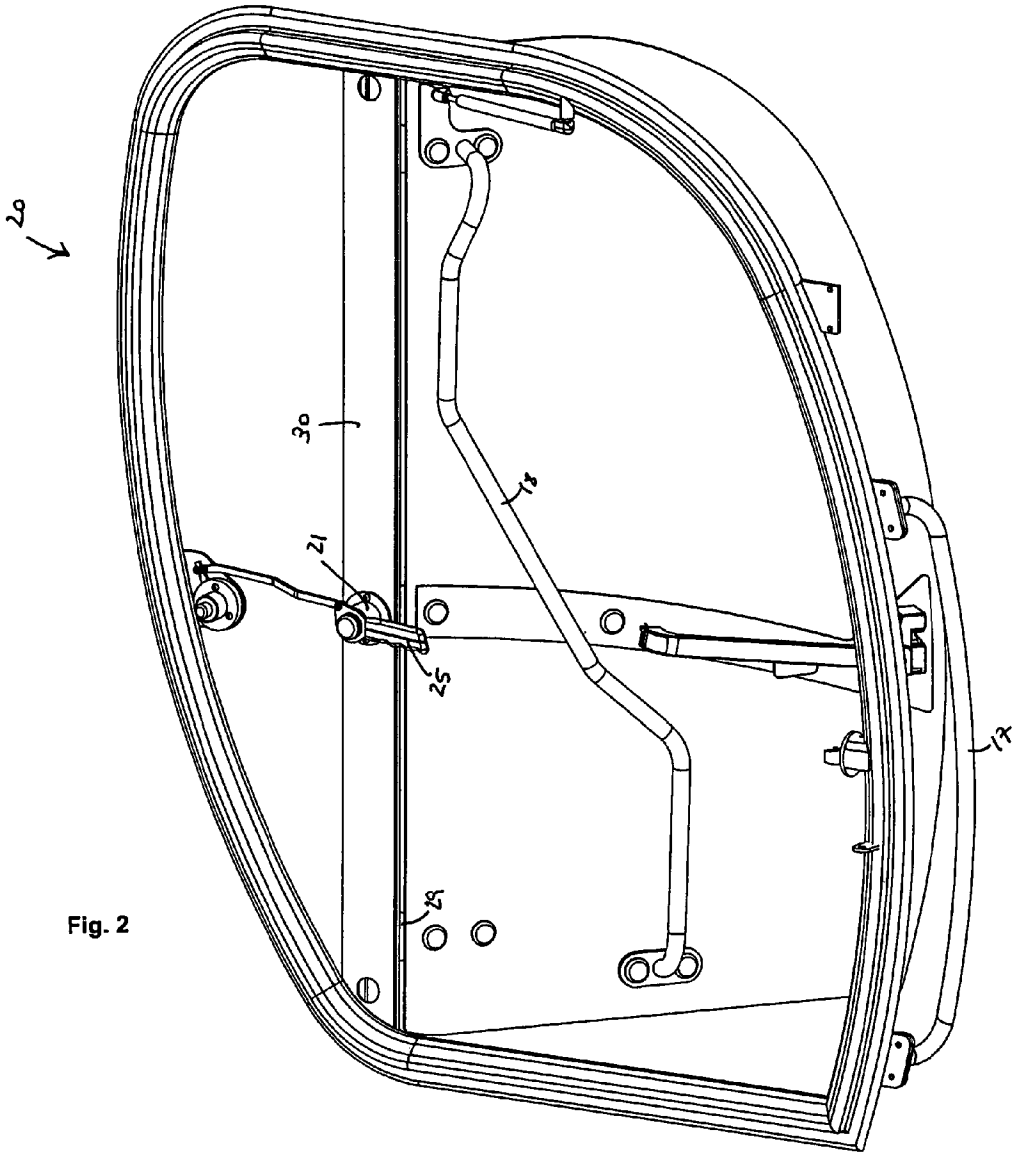
FIG. 2 is an interior view of the partially opened door of FIG. 1.

It is to be understood that while the following description of the present invention is based on the exemplary illustrated embodiments, the scope of the invention is not limited to this description, the illustrations, nor any of the particular locations or combinations depicted, but may be installed in various alternative locations, and in various alternative combinations, without affecting the scope or functionality thereof. Referring then to the exemplary embodiments illustrated in the drawings wherein like reference characters designates like or corresponding parts throughout the several views, and referring particularly to FIGS. 1-2 and 7-8, it is seen that the invention includes a latching mechanism 21 attached to a cross member 30 on a vehicle cab door frame 40 supporting a handle 25. Cross member 30 may be vertically or horizontally oriented, or may be part of the wall of the cab 20. Cab door 50 is attached via hinges 29 to cross member 30. Hand rails such as those illustrated as items 17, 18 are provided on frame 40 and/or door 50 to assist a user in mounting and entering the cab 20.

Figure 3:
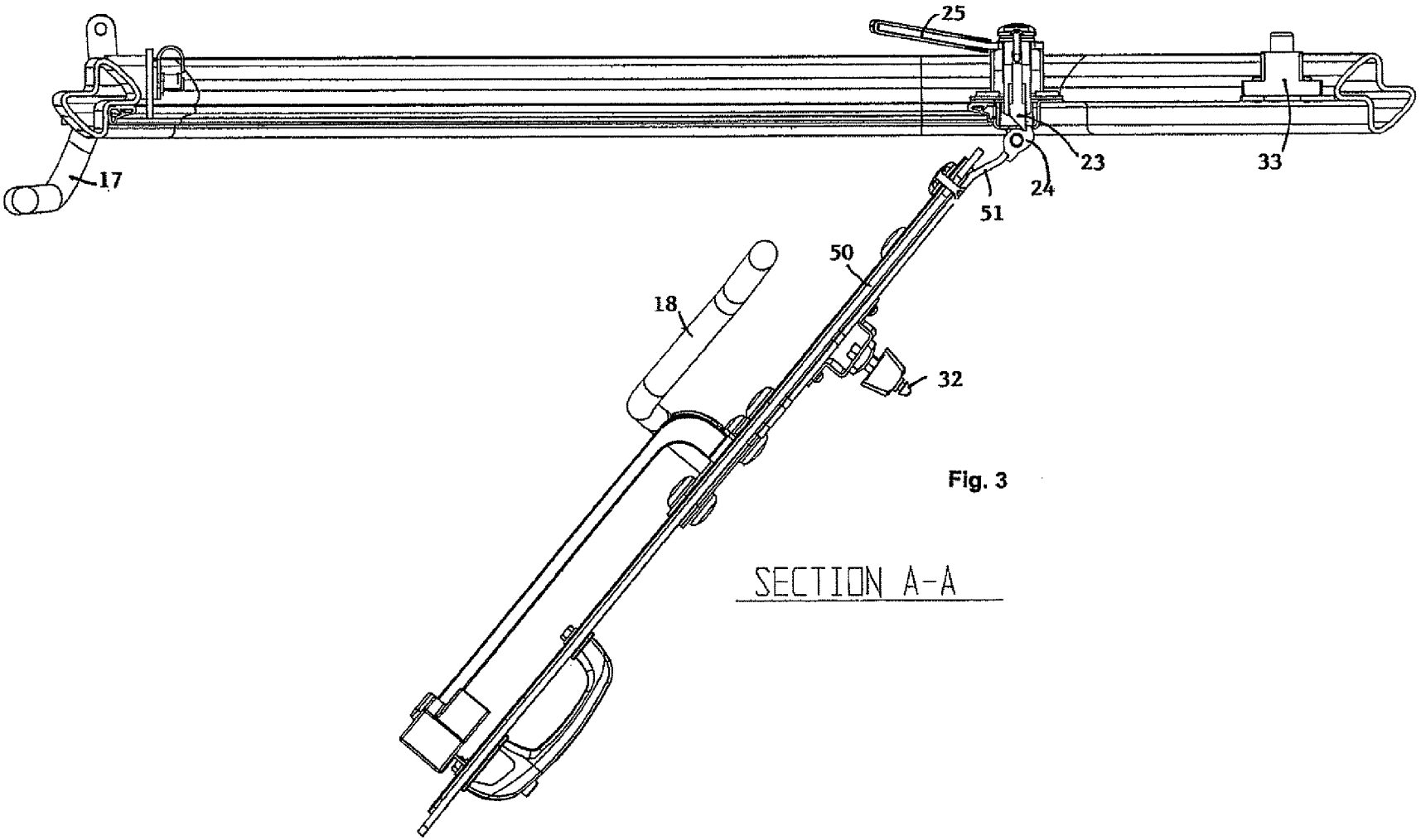
FIG. 3 is a sectional view of the embodiment of FIG. 1.
Figure 4:
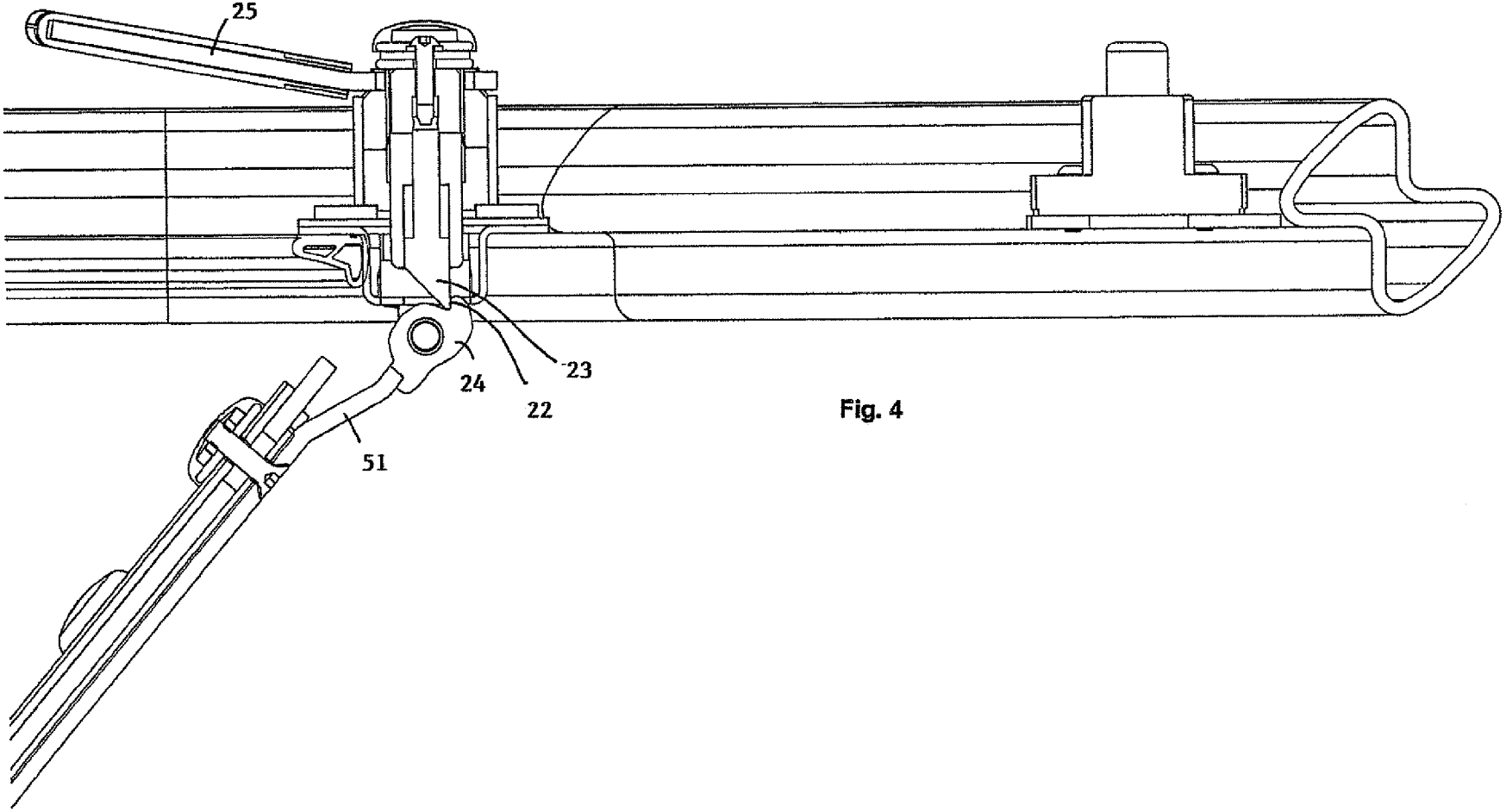
FIG. 4 is a detailed sectional view of FIG. 3.
Figure 5:
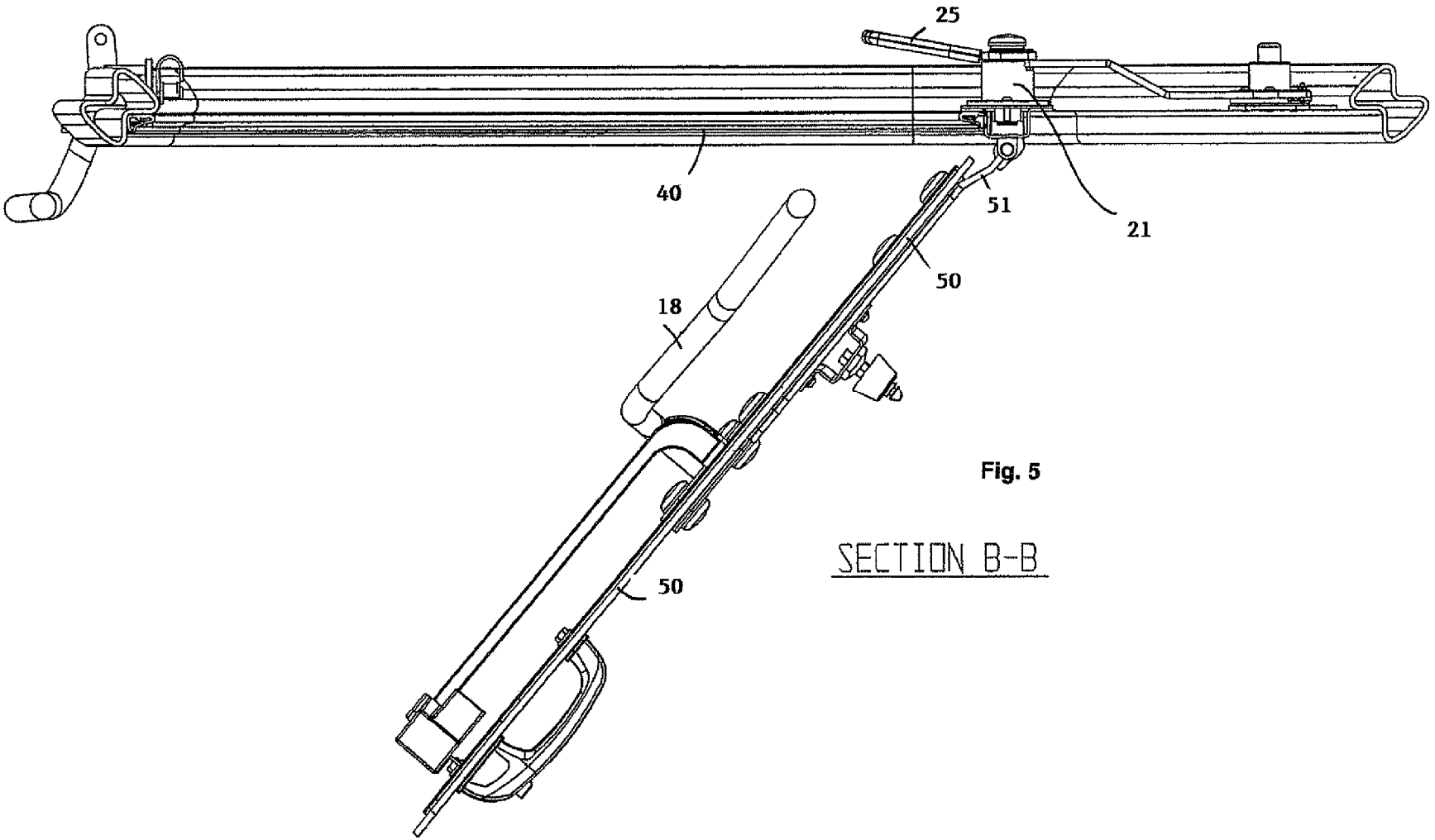
FIG. 5 is another sectional view of the embodiment of FIG. 1.
Figure 6:
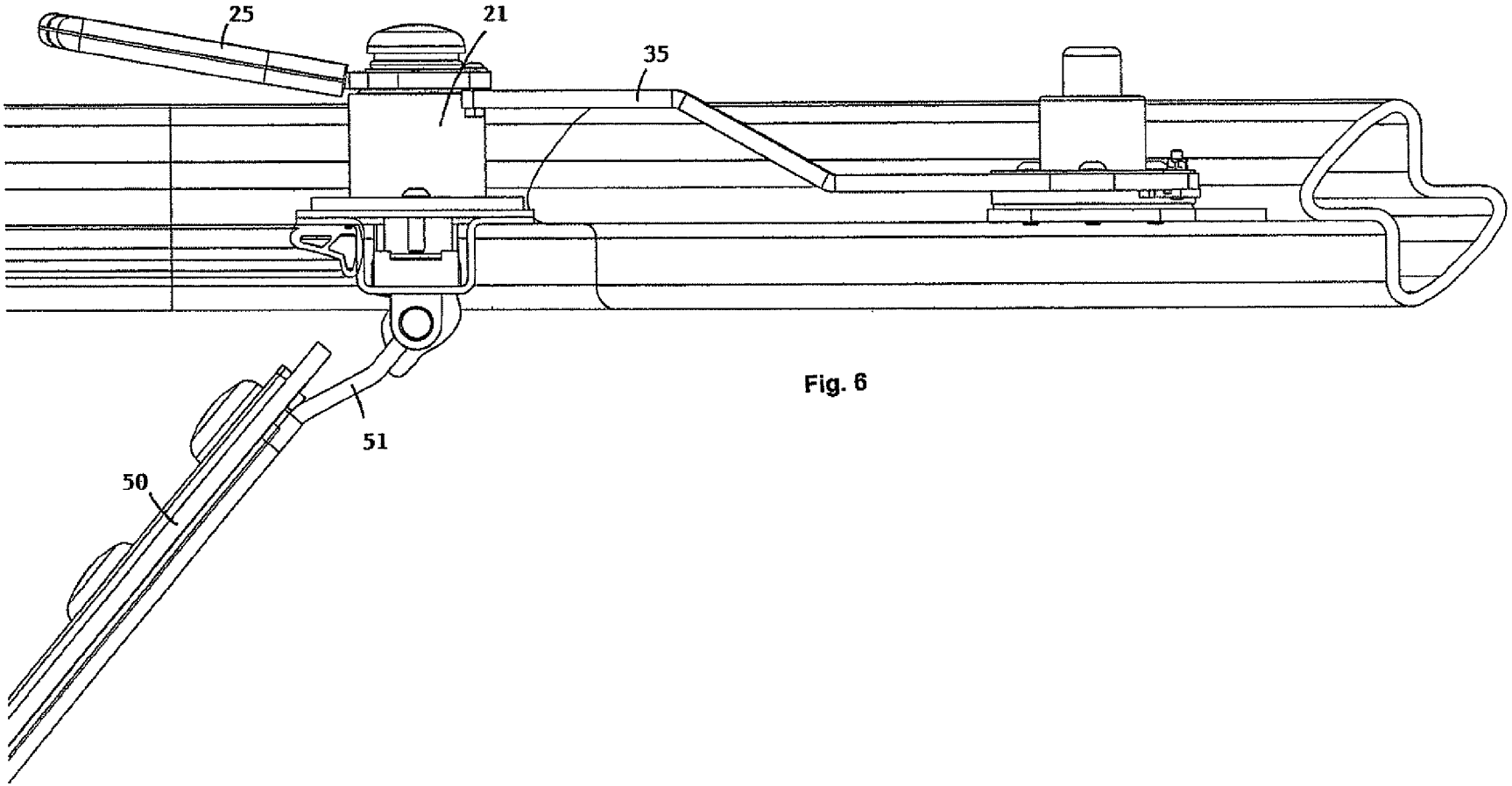
FIG. 6 is a detailed sectional view of FIG. 5.
Figure 7:
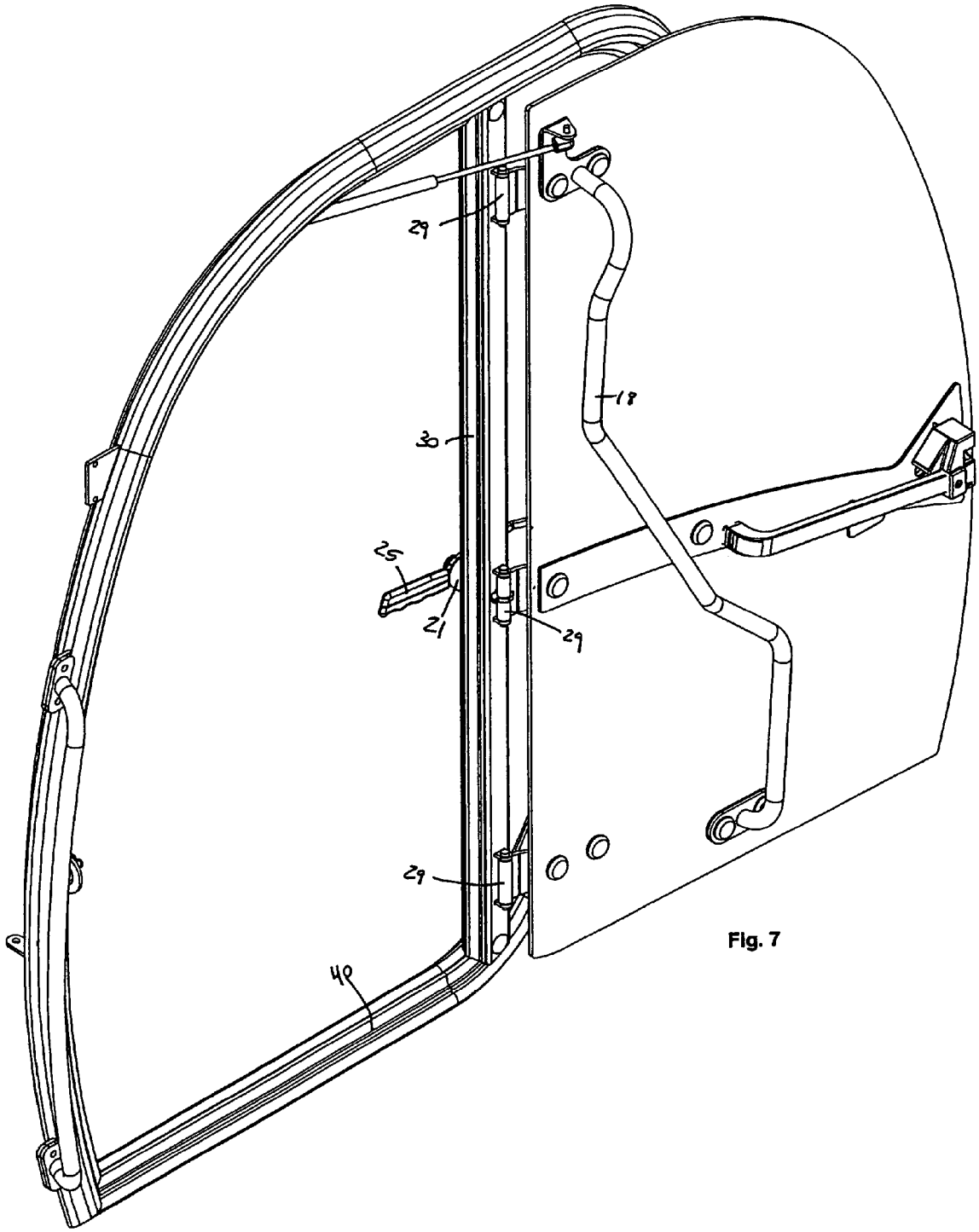
FIG. 7 is an exterior perspective view of an embodiment of the present invention illustrating a cab door in a fully opened position that has been engaged with the side of the cab.
Figure 8:
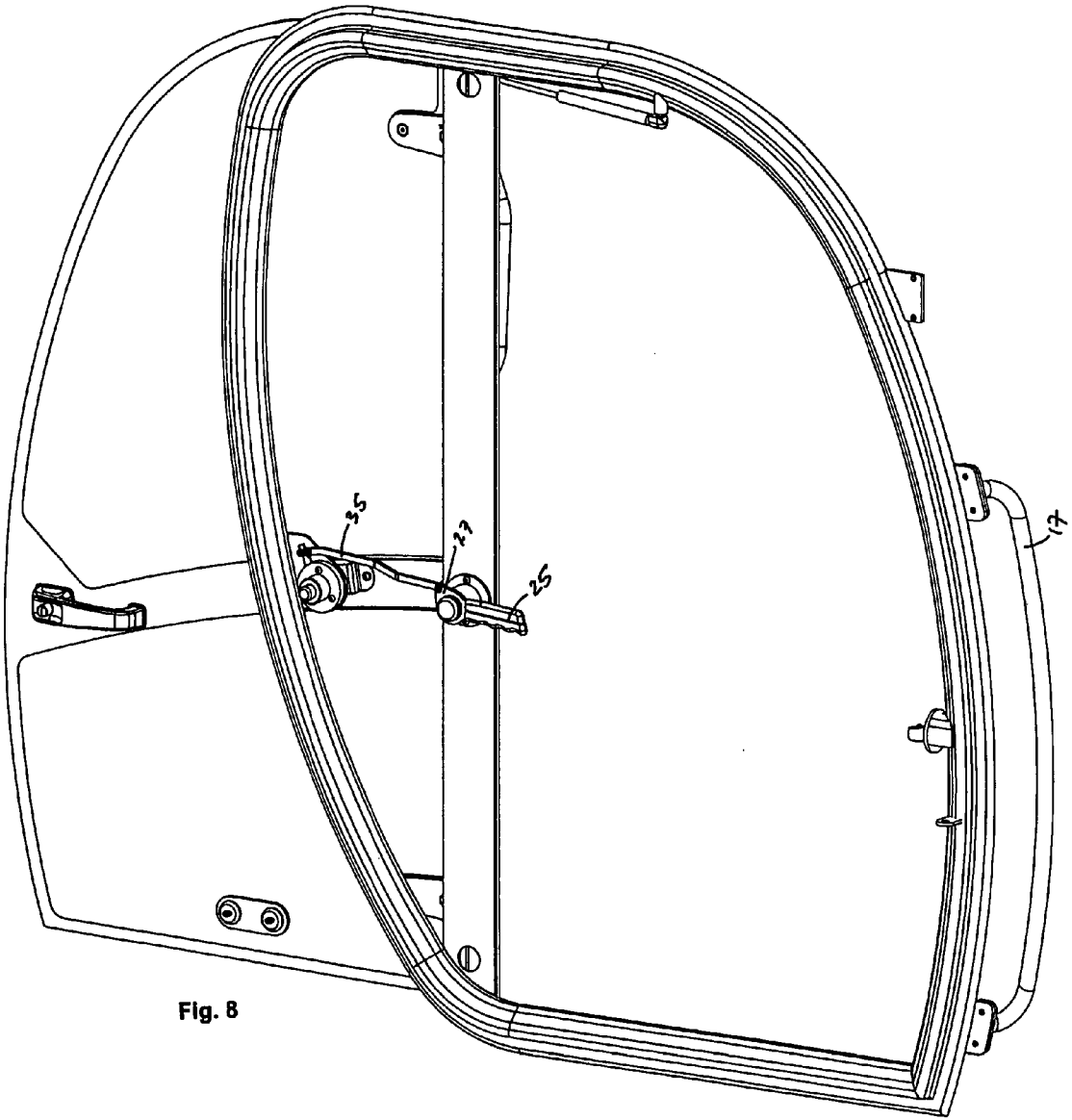
FIG. 8 is an interior view of the fully opened door of FIG. 7.
Figure 9:
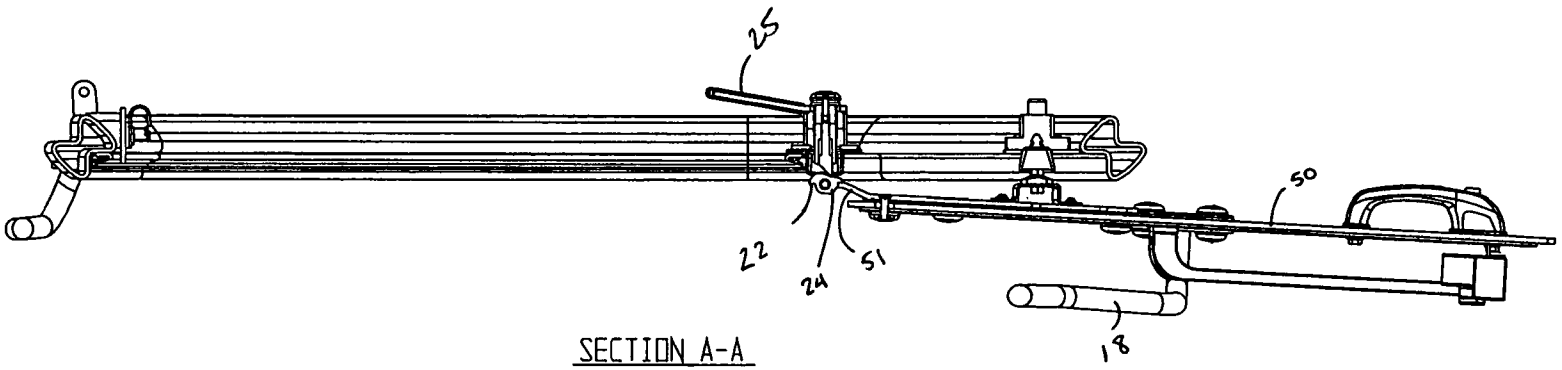
FIG. 9 is a sectional view of the embodiment of FIG. 7.
Figure 10:
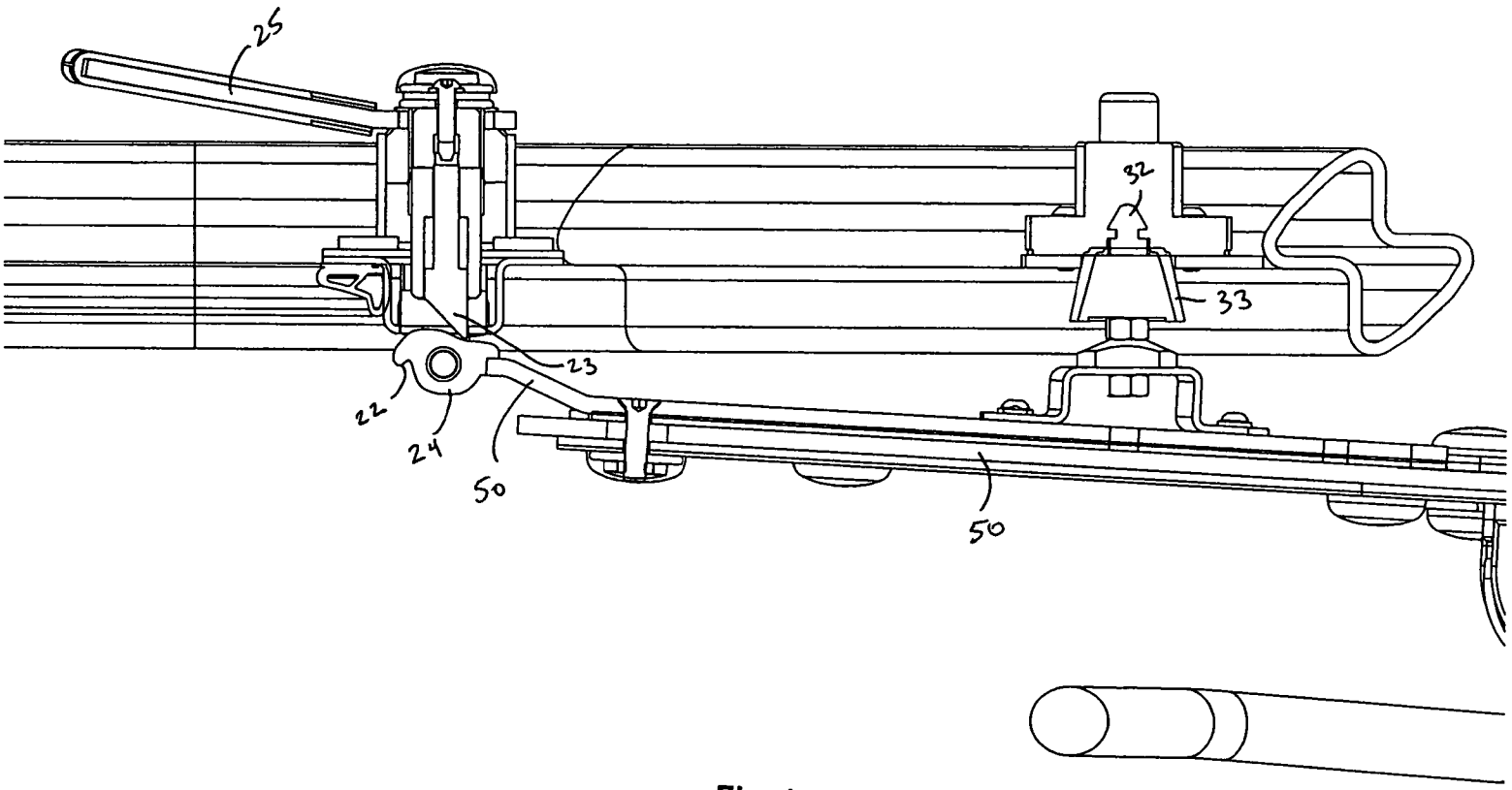
FIG. 10 is a detailed sectional view of FIG. 9.
Figure 15:
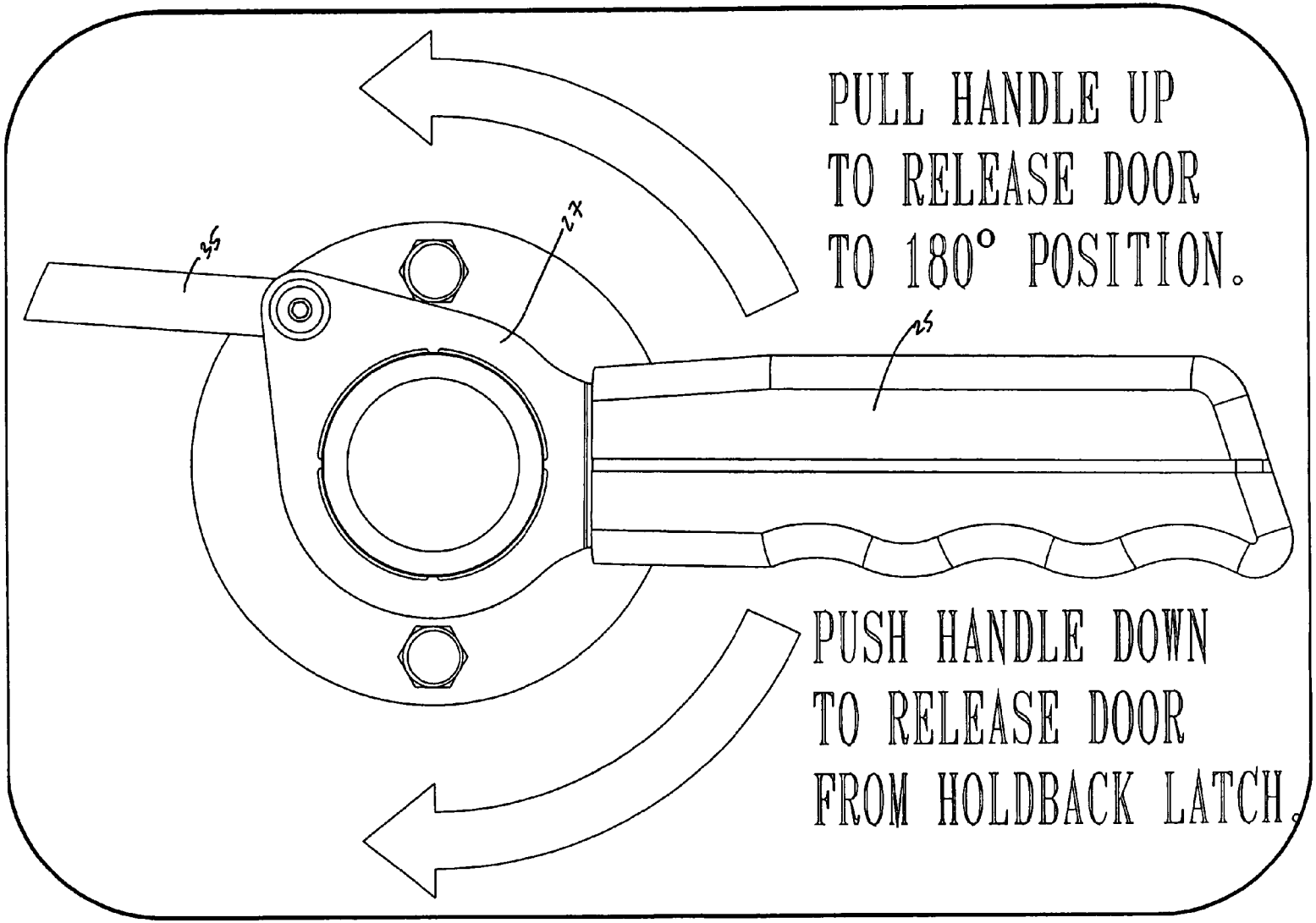
FIG. 15 is a detailed view of an embodiment of the present invention.

Referring to FIGS. 1-6, it is seen that door 50 of this illustrated embodiment has been partially opened. An extension 51 on door 50 is attached to a cam 24 which is pivotally mounted preferably in axial alignment with hinges 29. In some embodiments cam 24 may be incorporated into one of hinges 29. Cam 24 includes a stop 22 that engages a latch bolt 23 of the latching mechanism 21 as shown in FIGS. 3 and 4. The interaction of latch bolt 23 and stop 22 prevents door 50 from opening further, until latch bolt 23 is retracted. This retraction may be accomplished by rotating handle 25 upward (see FIG. 15), although downward rotation will also retract bolt 23. It is to be appreciated that the location of stop 22 on cam 24 may be changed, changing the position at which door 50 is stopped from further opening according to such changed location.

FIGS. 7-12 illustrate the position of door 50 after latch bolt 23 has been retracted releasing stop 22 of cam 24. In these figures, door 50 has been swung fully open, and engaged against the side of the cab 20 in a holdback position. In particular, coupling nipple 32 on door 50 has been inserted into mating member 33 on the vehicle cab, holding door 50 against the side of the cab. See FIG. 10. A release mechanism 38 with an exemplary button 39 or other suitable mechanism is provided inside the cab as part of mating member 33. Operating release mechanism 38 retracts an internal spring-loaded mechanism holding nipple 32 thereby releasing nipple 32 and allowing door 50 to swing freely. In the exemplary illustrated embodiment, this release may be accomplished by depressing button 39, or by toggling a release lever 34.

Figure 11:
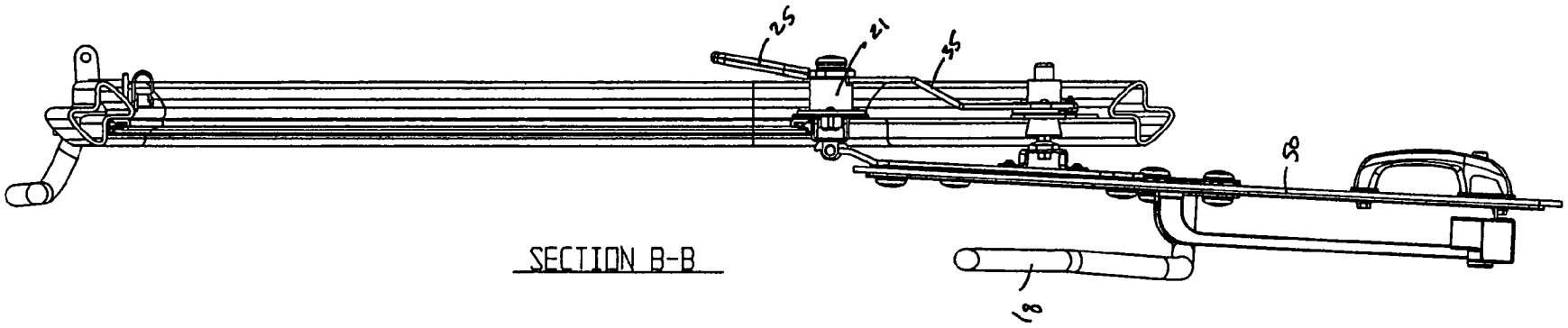
FIG. 11 is another sectional view of the embodiment of FIG. 7.
Figure 12:
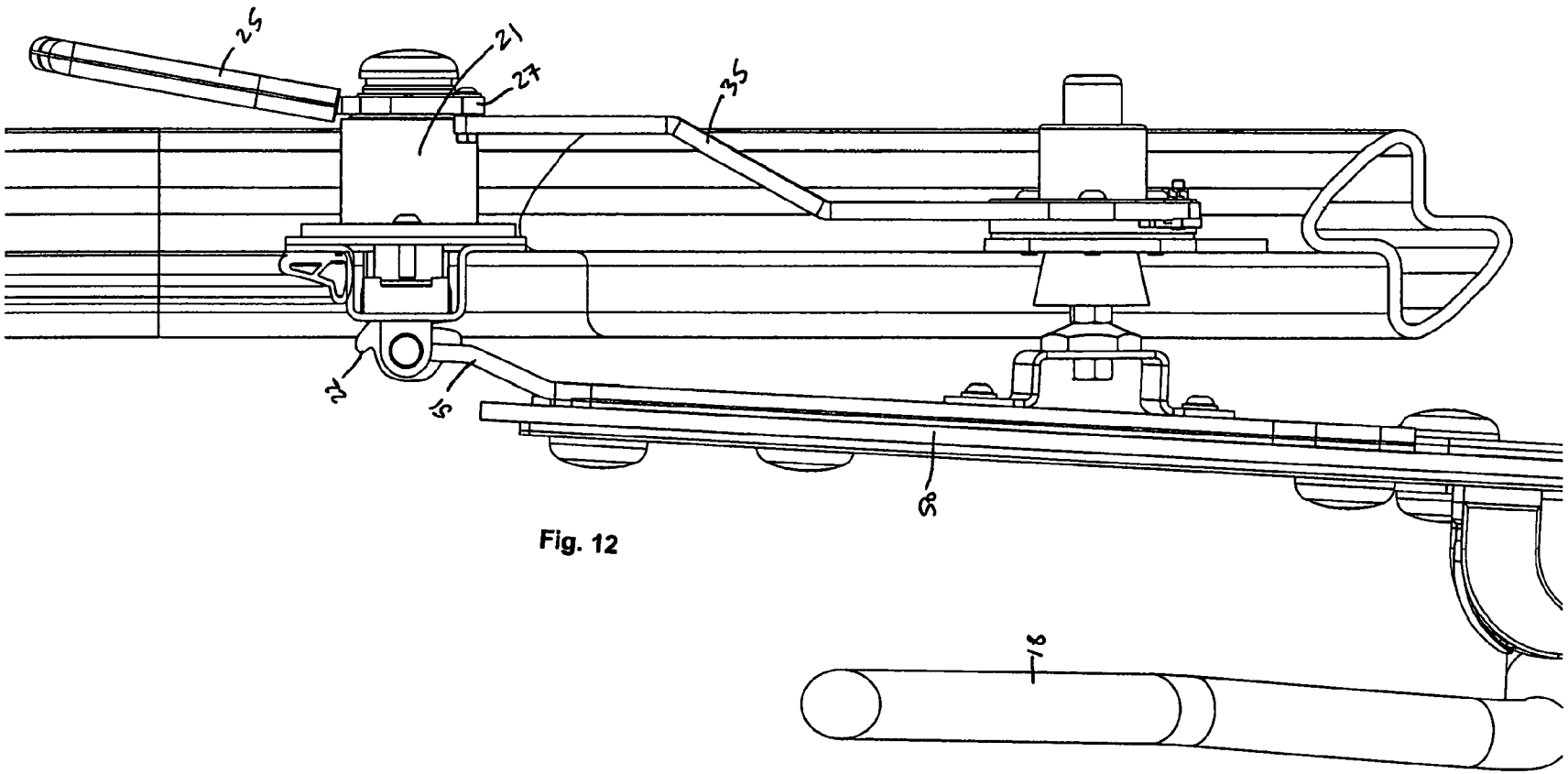
FIG. 12 is a detailed sectional view of FIG. 11.
Figure 13:
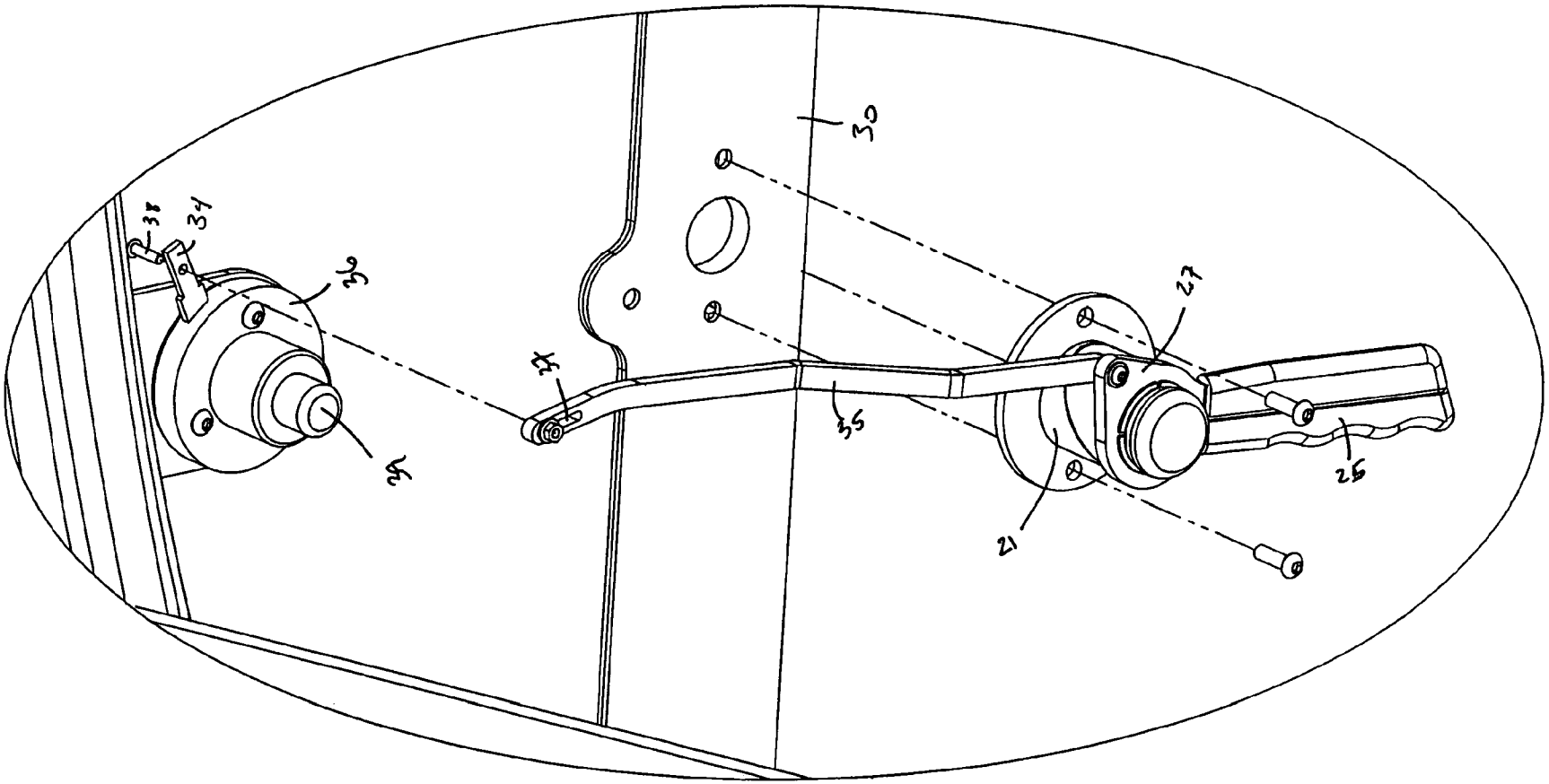
FIG. 13 is a perspective partially exploded view showing the attachment of an embodiment of the present invention to a vehicle cab.
Figure 14:
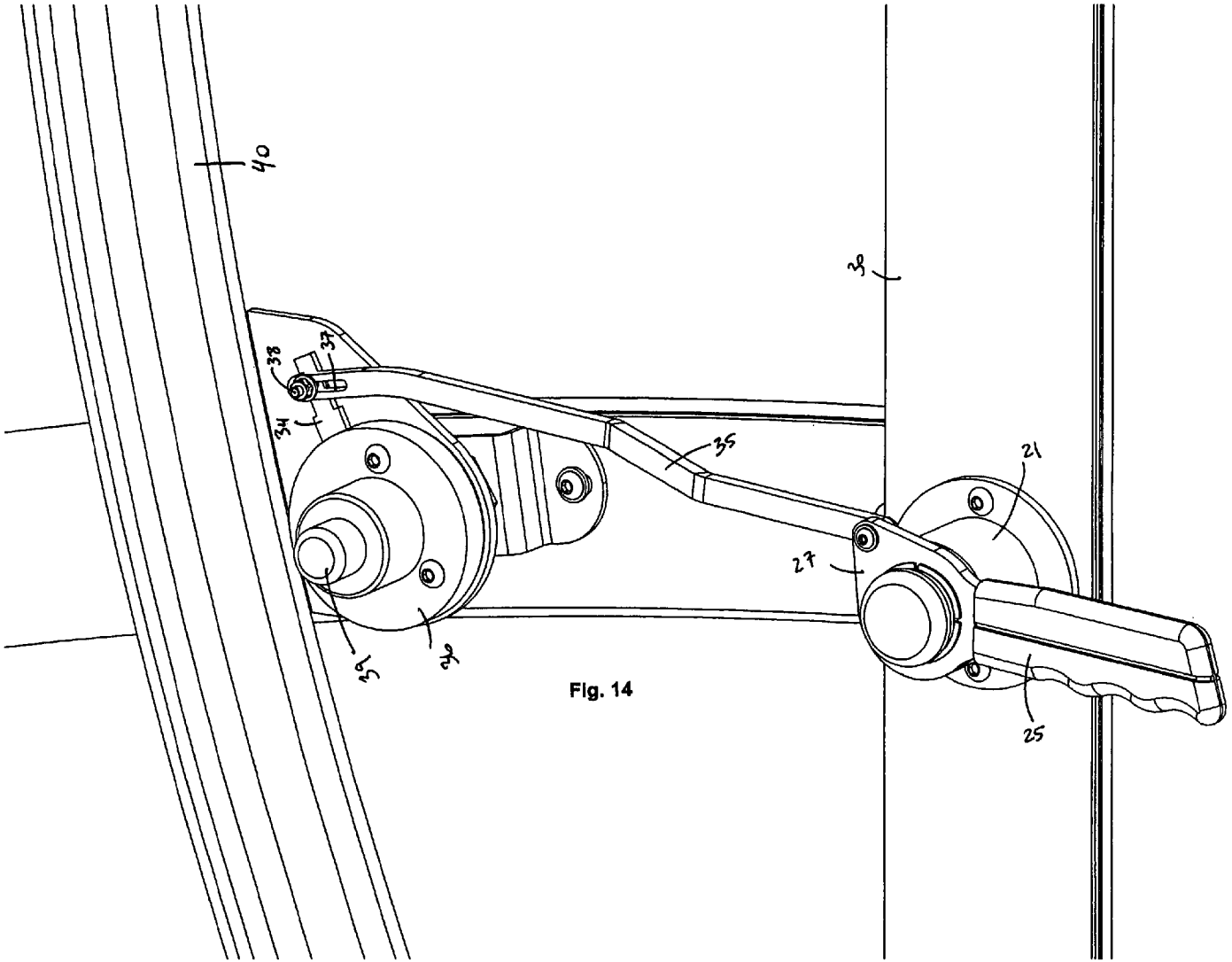
FIG. 14 is a detailed perspective view showing the attachment of an embodiment of the present invention to a vehicle cab.

Referring to the exemplary illustrated embodiment of FIGS. 11-13, it is seen that a linkage 35 is provided between a rotatable portion 27 of handle 25 and the release mechanism 38, such as to lever 34. The ends of linkage 35 may be pivotally attached, such that rotating handle 25 downward causes portion 27 to move linkage 35, pulling linkage 35 away from release mechanism 38. This motion causes lever 34 to be toggled, thereby releasing nipple 32 from mating member 33. Referring to FIGS. 13 and 14, it is seen that in the preferred embodiment, the connection between linkage 35 and lever 34 is accomplished using a bolt or other fastener 43 that is inserted through an elongated slot 37 on linkage 35. This allows fastener 43 to slide inside slot 37. No motion is imparted to fastener 38 (or to lever 34) until fastener 38 reaches one end or the other of slot 37. Fastener 43 may be pivotally attached directly or indirectly to lever 34. In the illustrated exemplary embodiment, fastener 43 is pivotally attached through an opening on lever 34. It is to be appreciated that upward movement of handle 25 may not necessarily impart movement to lever 34 as a result of the slidable mounting of linkage 35 to lever 34 through fastener 43 deployed in elongated slot 37. See FIG. 15. However, in other embodiments, such upward movement may impart movement to lever 34 or to an equivalent structure.

Figure 16B:
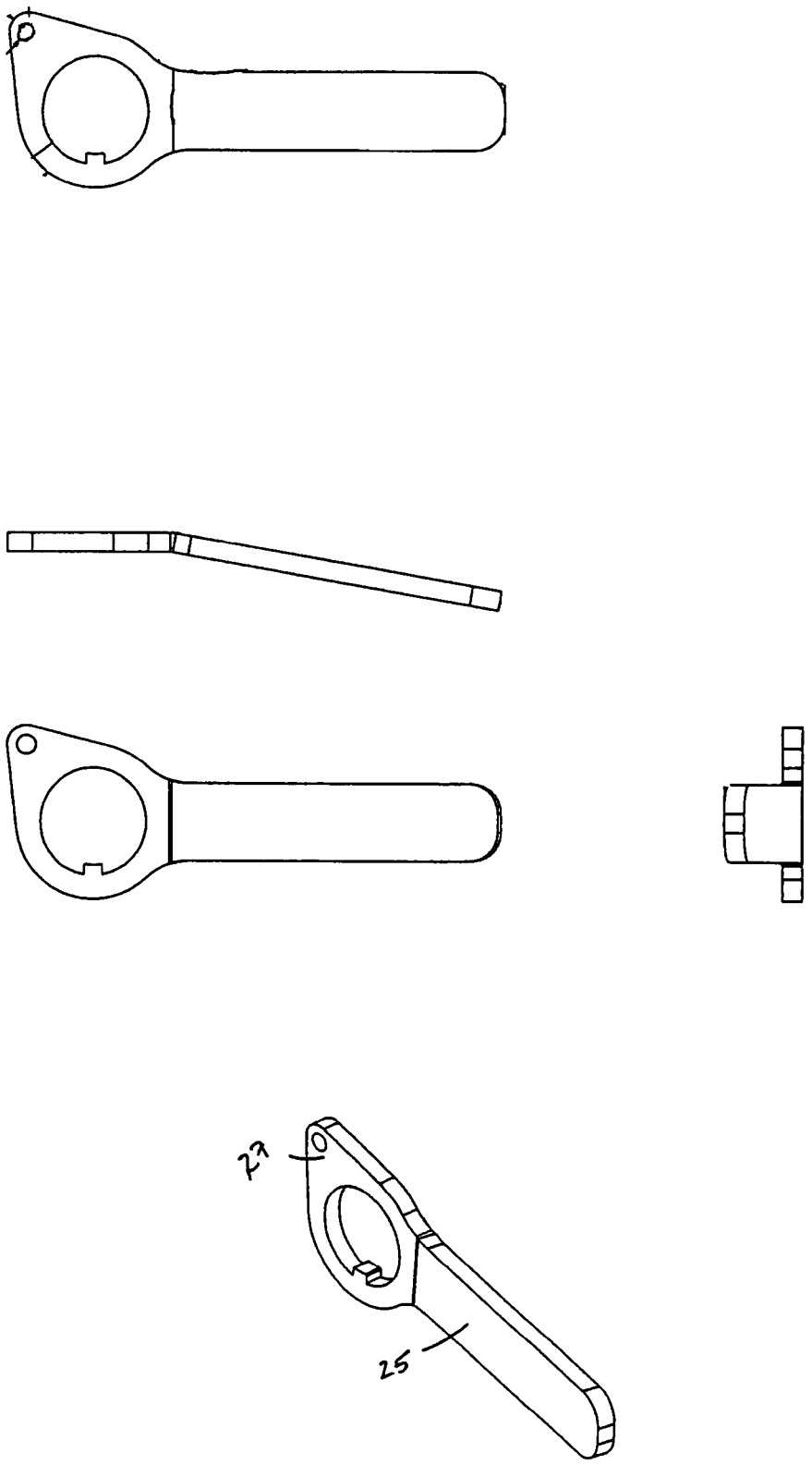
FIG. 16B is a set of detailed drawings of an embodiment of a handle of the present invention.
Figure 16C:
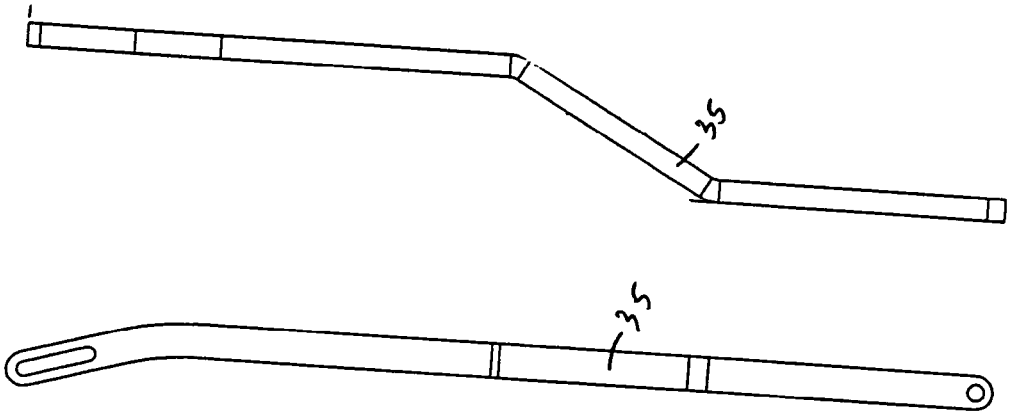
FIG. 16C is a set of detailed drawings of an embodiment of a linkage of the present invention.

Detail of the internal parts of an embodiment of the latching mechanism 21 and of a linkage 35 are illustrated in FIGS. 16A-G. In this exemplary embodiment one end of handle 25 is enlarged and includes an opening for receiving a bushing 9 around which handle 25 rotates. The enlarged section also includes a portion 27 having a smaller opening thereon for receiving a pivotally mounted fastener 16 that attaches linkage 35 to portion 27 of handle 25. Referring to FIG. 16A it is seen that the internal latching mechanism includes washers, bolts, bushings and other parts detailed in that illustration. Handle 25 may be provided with a rubberized cover 11.

Figure 16D:
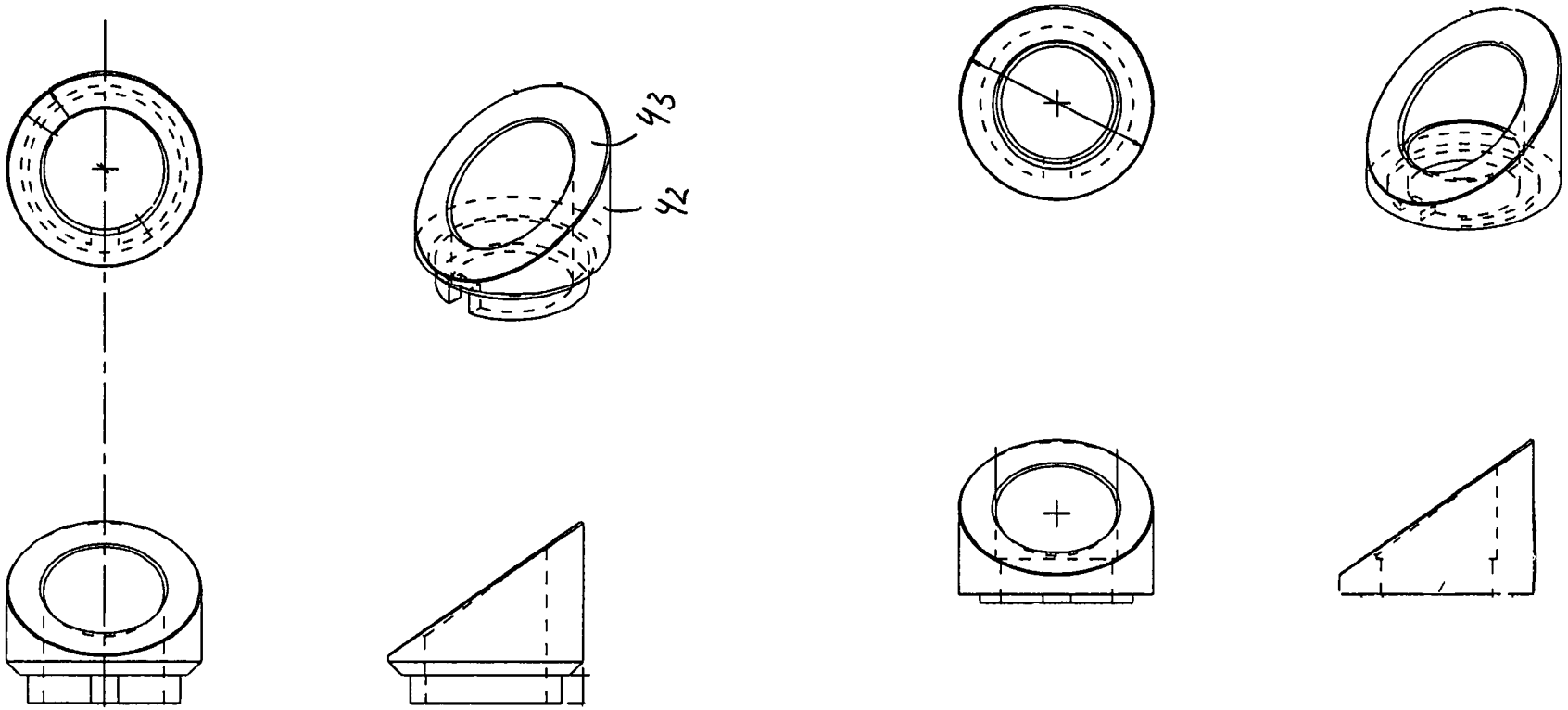
FIG. 16D is a set of detailed drawings of an embodiment of an interior cam used with a handle of the present invention.
Figure 16E:
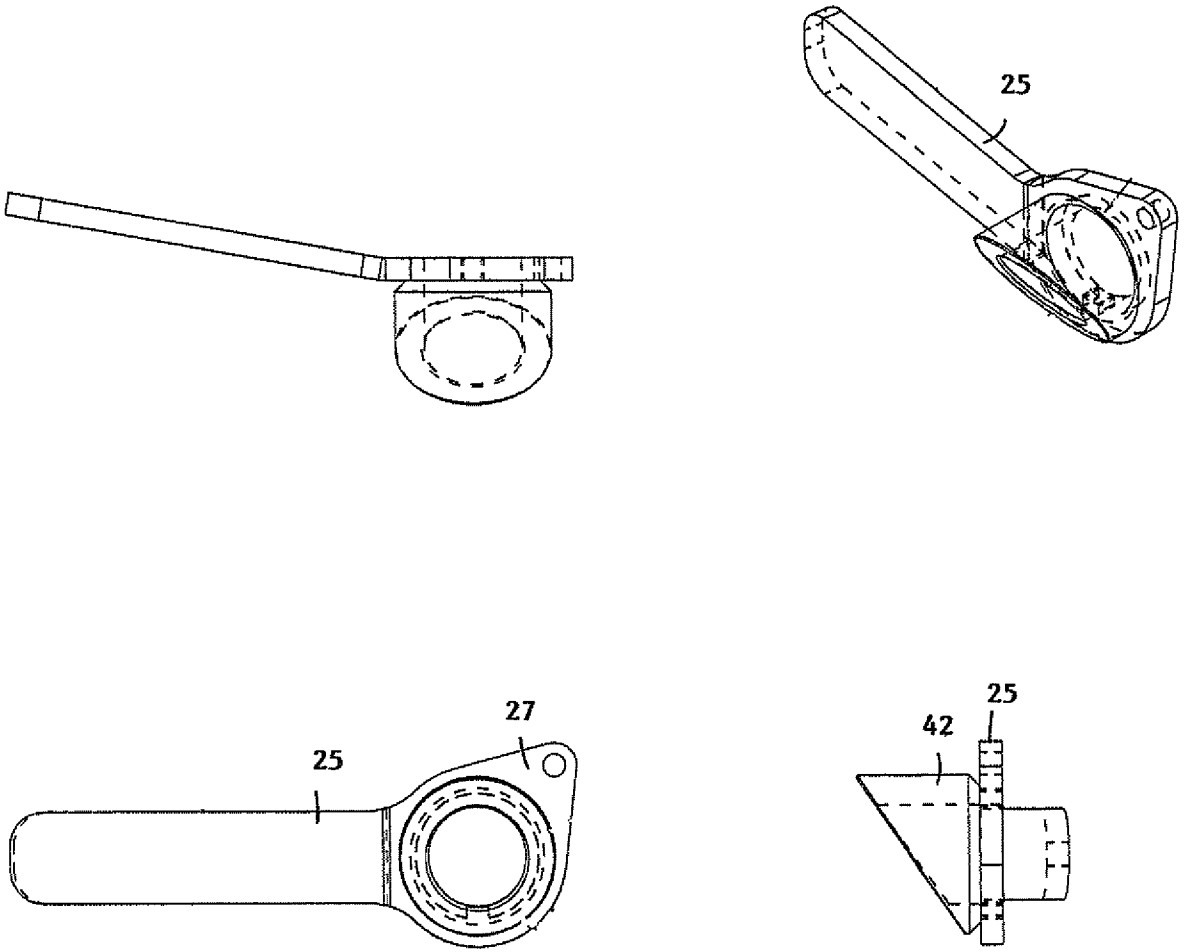
FIG. 16E is a set of detailed drawings of an embodiment of a cam and handle assembly of the present invention.
Figure 16F:
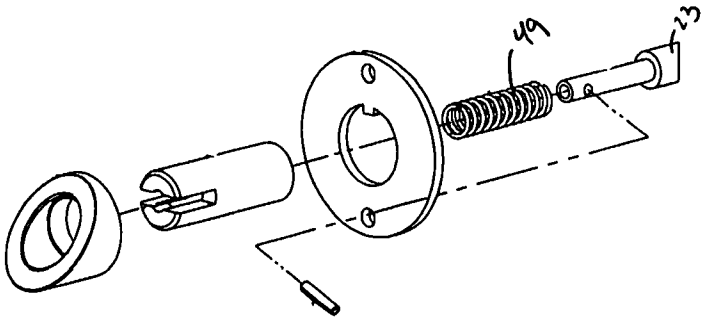
FIG. 16F is a set of detailed drawings of an embodiment of a latch bolt and cam assembly of the present invention.
Figure 16F:
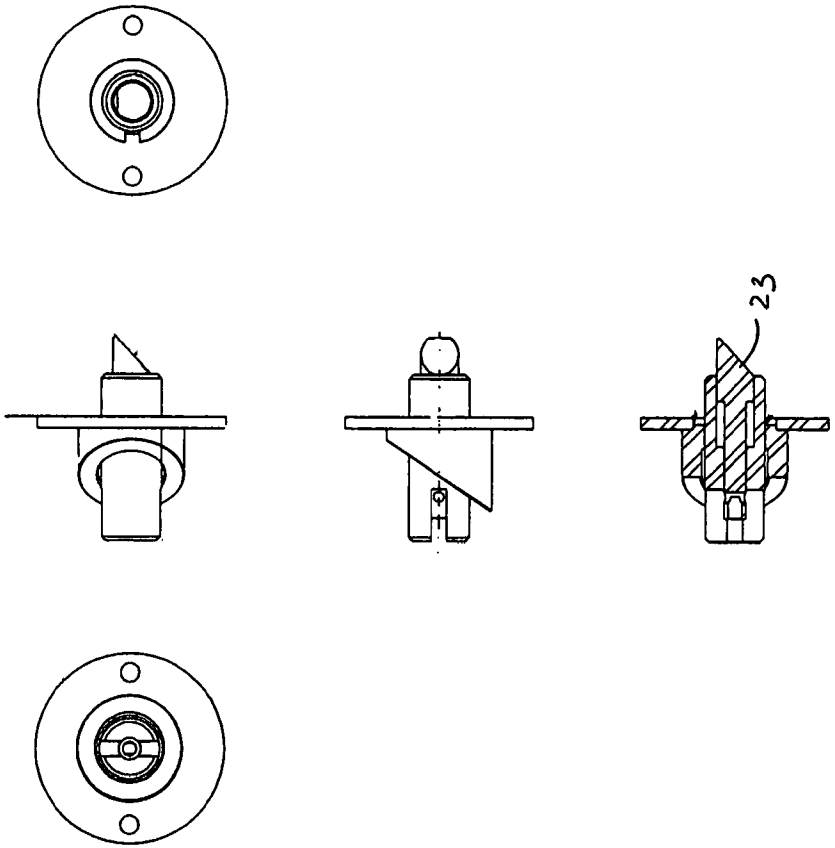
Figure 16G:
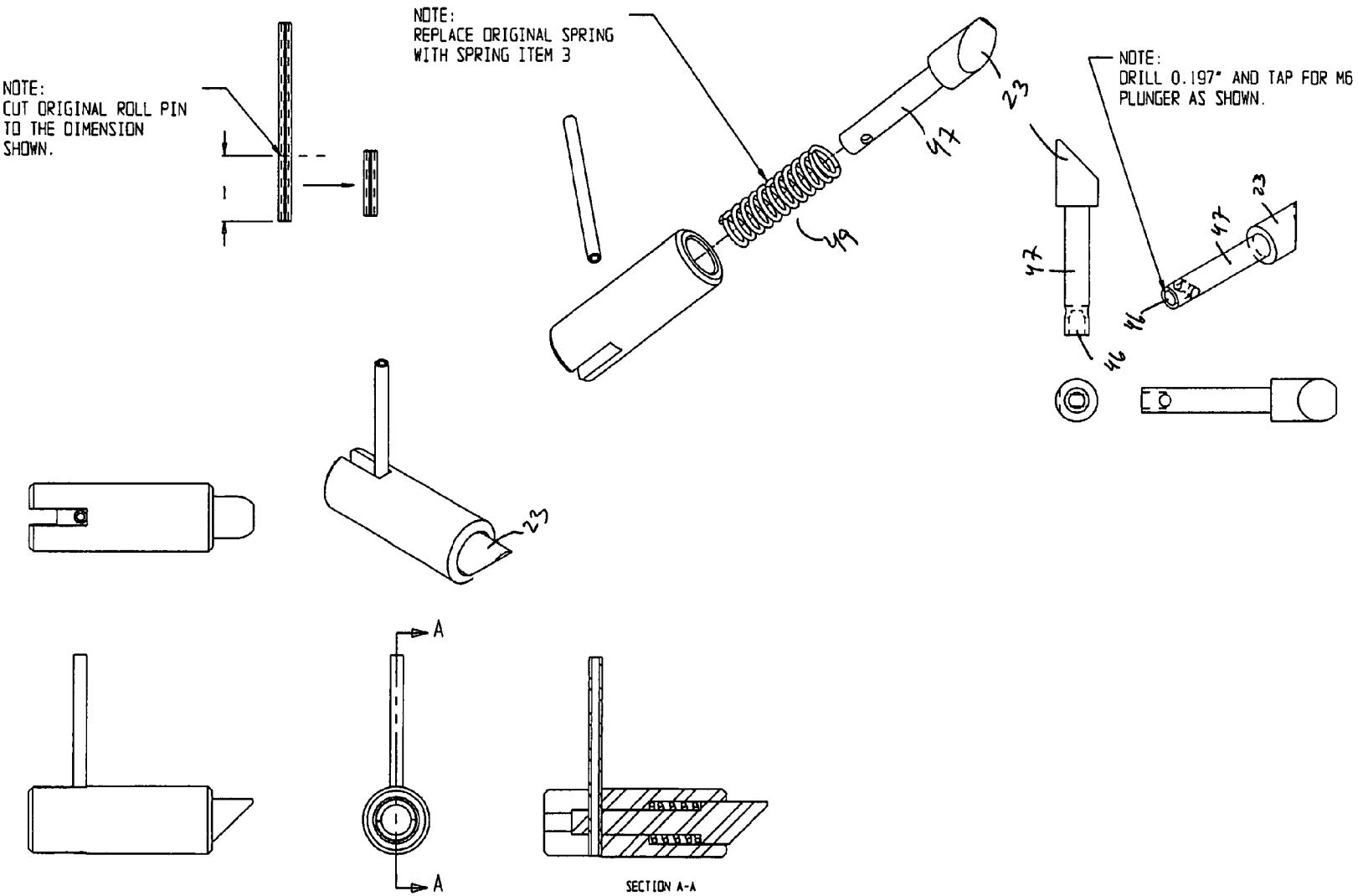
FIG. 16G is a set of detailed drawings of an embodiment of a latch bolt assembly of the present invention.

Referring to FIG. 16D, an exemplary embodiment of a bushing 42 with angled cam surface 43 is shown. The angle of surface 43 in the illustrated exemplary embodiment is approximately 55 degrees, but any suitable angle may be used so long as it is relatively steep in order to cause bolt 23 to retract by moving handle 25 through a short arc of rotation. This is because it is desirable for only a slight downward pull on handle 25 to be enough to retract bolt 23 and to release the coupling 38. FIG. 16E shows detail of the attachment of exemplary bushings 42 to handle 25. FIG. 16F illustrates an exemplary corresponding bushing 44 with angled cam 45 that is engaged with bolt 23. The angle of surface 45 should be the same as or complementary to that of surface 43 against which it bears when assembled. Biasing member or spring 49 urges bolt 23 to extend out when at rest. Rotating handle 25 causes angled surfaces 43 to move relative to surface 45, causing to bolt 23 to be retracted. When handle 25 is released, spring 49 again causes bolt 23 to extend out again. The retraction of bolt 23 removes it from cam stop 22 allowing cam 24 and door 50 to freely rotate on the mounting hinges 29. FIG. 16G illustrates an exemplary embodiment of the mechanism engaging bolt 23. It is to be appreciated that bolt 23 is attached to a rod 47 having an opening 46 at the end thereof. Bolt 15 (see FIG. 16A) is engaged to rod 47 though opening 46. The bushings and washers inside mechanism 21 are arranged such that rod 47 is pulled inward when handle 25 is rotated through an arc, retracting bolt 23.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

What is claimed is:

1. A dual release apparatus in combination with a vehicle cab door comprising:

a. a vehicle cab having a hingedly mounted door movable between a closed position and an open position;

b. a stop associated with said door for preventing said door from moving beyond an intermediate position, said intermediate position being between said closed and said open positions;

c. a first release member operably connected to said stop for allowing said door to move beyond said intermediate position;

d. a latching member for holding said door in said open position;

e. a second release member operably connected to said latching member for releasing said door from said open position; and f. a linkage connected between said first release member and said second release member such that operation of said first release member also operates said second release member.

2. The apparatus of claim 1 wherein said stop is provided on a cam that is attached to said door.

3. The apparatus of claim 2 wherein the stop on said cam arrests movement of said door only when it is opening but not when it is closing.

4. The apparatus of claim 2 wherein said door is supported by at least one hinge having an axis of rotation, and the cam is in axial alignment with said at least one hinge.

5. The apparatus of claim 2 wherein said cam is part of a hinge supporting the door.

6. The apparatus of claim 1 wherein operation of said first release member causes said door to be released from said open position.

7. The apparatus of claim 1 further comprising a handle associated with said first release member, said handle being located inside said vehicle cab.

8. The apparatus of claim 7 wherein said handle extends into a doorway for said door so that it may be reached from outside said cab when said door is open.

9. The apparatus of claim 7 wherein said second release member is located inside said cab.

10. The apparatus of claim 9 wherein said linkage extends between said handle and said second release member.

11. The apparatus of claim 1 wherein said first release member comprises a handle that is located inside said cab that may be reached from outside said cab when said door is open.

12. The apparatus of claim 11 wherein said linkage extends between said handle and said second release member.

13. The apparatus of claim 1 wherein a slot is provided in said linkage where it is attached to said second release member, and a fastener is provided on said second release member for slidable engagement with said slot.

14. The apparatus of claim 1 wherein a coupling nipple is provided on said door for temporary engagement with said latching member.

15. A dual release device in combination with a door of a vehicle cab comprising:

a. a first releasable latch mounted on a vehicle cab adjacent to a door thereof, said latch including a bolt extending outward from said cab, and a pivotally mounted handle on an interior side of said cab for operating said latch, said handle extending into a doorway for said door;

b. a cam attached to said door, said cam having a stop thereon for temporary engagement with said bolt to arrest opening movement of said door;

c. a second releasable holdback latch mounted on an exterior of said cab said holdback latch having a release on the interior side of said cab, and a corresponding mating member mounted on said door such that engagement of said mating member with said holdback latch temporarily holds said door in an open position; and d. a linkage having a first end operably attached to said handle and an opposite end operably attached to the release of said holdback latch such that operation of said handle releases said first latch and also releases said second holdback latch.

16. The dual release device of claim 15 wherein the attachment between said linkage and said holdback release mechanism comprises a slot in said linkage at said opposite end, and a fastener on said holdback release for slidable engagement with said slot.

17. The dual release device of claim 15 further comprising at least one hinge for supporting said door on said cab, said at least one hinge defining an axis of rotation, and wherein said cam is provided in axial alignment with said at least one hinge.

18. The dual release device of claim 15 wherein said cam comprises a generally curved edge around a center and wherein said stop comprises a generally flat edge extending radially outward from the center of said cam for temporary engagement with a flat edge of said bolt.

19. The dual release device of claim 15 wherein said mating member on said door comprises a coupling nipple extending outward from the door that is aligned for temporary engagement with said holdback latch.

20. The dual release device of claim 19 wherein the coupling nipple is rounded and has a groove running along a circumference thereof to engage with the holdback latch to temporarily hold the door in an open position.

21. The dual release device of claim 15 wherein said cam is part of a hinge supporting said door.

22. The dual release device of claim 15 wherein said handle is provided on a first bushing and said first end of said linkage is attached to said first bushing, and a second bushing is provided on the release of said holdback latch and said second end of said linkage is attached to said second bushing.

23. In combination, a vehicle cab, a door, and a dual release device for said door comprising:

a. a vehicle cab having a door hingedly mounted thereto for closing a doorway in said cab;

b. a first releasable latch mounted on said cab adjacent to said door, said latch including a bolt extending outward from said cab, and a pivotally mounted handle on an interior side of said cab for operating said latch, said handle extending into said doorway;

c. a cam attached to said door, said cam having a stop thereon for temporary engagement with said bolt to arrest opening movement of said door;

d. a second releasable holdback latch mounted on an exterior of said cab said holdback latch having a release on the interior side of said cab, and a corresponding mating member mounted on said door such that engagement of said mating member with said holdback latch temporarily holds said door in an open position; and e. a linkage having a first end operably attached to said handle and an opposite end operably attached to the release of said holdback latch such that operation of said handle releases said first latch and also releases said second holdback latch.

* * * * *